United States Patent [19]

Resler, Jr.

[11] 4,015,161

[45] Mar. 29, 1977

[54] ANTI-POLLUTION SPARK PLUG

[75] Inventor: Edwin L. Resler, Jr., Ithaca, N.Y.

[73] Assignee: Cornell Research Foundation, Inc., Ithaca, N.Y.

[22] Filed: Sept. 4, 1975

[21] Appl. No.: 610,297

[52] U.S. Cl. ..... 313/143; 313/118

[51] Int. Cl.[2] ..... H01T 13/20

[58] Field of Search ..... 313/143, 118

[56] References Cited

UNITED STATES PATENTS

| | | | |
|---|---|---|---|
| 1,429,017 | 9/1922 | Cartmill | 313/143 |
| 2,608,186 | 8/1952 | Hudson | 313/143 X |

*Primary Examiner*—Rudolph V. Rolinec
*Assistant Examiner*—Darwin R. Hostetter
*Attorney, Agent, or Firm*—Lawrence E. Laubscher; Ralph R. Barnard; Theodore C. Wood

[57] ABSTRACT

An anti-pollution spark plug is disclosed having a storage chamber contained in the body portion of the metal shell for receiving — via longitudinal passages contained in the externally threaded reduced portion of the metal shell — unburnt hydrocarbons from the cylinder during the compression stroke of the engine. During the subsequent expansion stroke following combustion, the unburnt hydrocarbons are returned to the cylinder for mixing (at a temperature of at least 2200° Rankine) with the oxides of nitrogen having an excess concentration relative to an equilibrium value defined by the pressure, temperature and composition parameters of the products of combustion, thereby to reduce the oxides of nitrogen to the equilibrium value.

2 Claims, 1 Drawing Figure

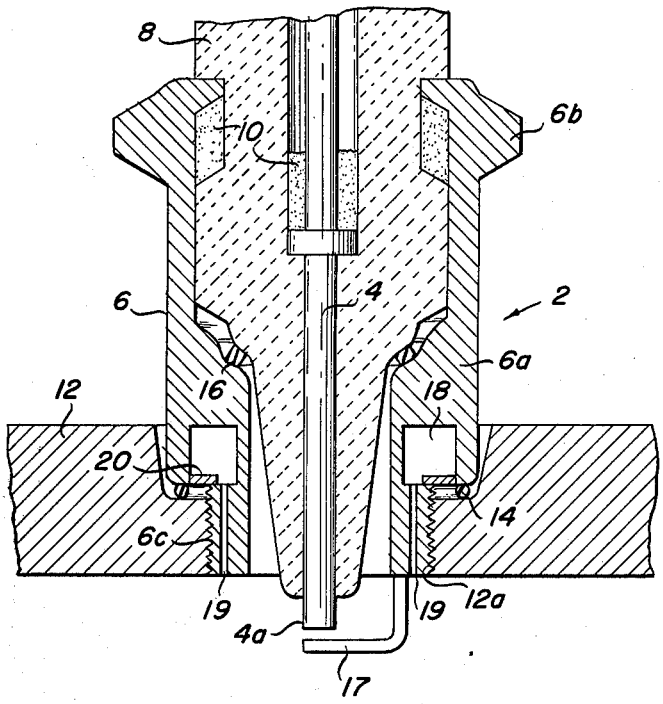
8
10
6b
6
4
2
6a
12
16
18
20
14
6c
19
19
12a
4a
17

ANTI-POLLUTION SPARK PLUG

REFERENCE TO COPENDING APPLICATION

The present invention relates to an improved anti-pollution spark plug of the type disclosed in my prior U.S. Patent Application Ser. No. 449,391 filed Mar. 8, 1974, which in turn is a continuation-in-part of the parent application Ser. No. 399,498 filed Sep. 21, 1973 now abandoned.

BRIEF DESCRIPTION OF THE PRIOR ART

As evidenced by the prior patents to Myerson U.S. Pat. No. 3,867,507, Kim U.S. Pat. No. 3,513,929 and Reed et al. U.S. Pat. No. 3,873,671, among others, various methods and apparatus have been proposed for reducing pollutants from the exhaust gases of internal combustion engines or the like.

In my aforementioned U.S. patent application Ser. No. 449,391 filed Mar. 8, 1974, a method and apparatus is disclosed for reducing undersirable oxides of nitrogen having an excess concentration relative to an equilibrium condition determined by the temperature, pressure and composition parameters of the combustion gases, wherein unburnt hydrocarbons are mixed with the oxides of nitrogen at a temperature of at least 2200° Rankine, thereby to reduce the oxides of nitrogen to the equilibrium value. Various embodiments are disclosed of internal combustion engines containing storage chambers in communication with the cylinders for receiving unburnt hydrocarbons during a compression stroke and for returning the hydrocarbons to the cylinder during the expansion stroke following combustion, whereby the unburnt hydrocarbons mix with the oxides of nitrogen and the reduction temperature is provided by the gases within the cylinder. In the disclosed embodiments, the storage chambers are contained in or mounted on the pistons, the walls of the cylinders or the head, or the spark plugs of the internal combustion engine.

SUMMARY OF THE INVENTION

The present invention was developed to provide an improved embodiment of an anti-pollution spark plug of the aforementioned type in which hydrocarbons are stored during the compression stroke for subsequent introduction into the cylinder during the expansion stroke.

Accordingly, a primary object of the present invention is to provide an anti-pollution spark plug wherein the storage chamber is contained in the body portion of the tubular metal shell of the spark plug, said storage chamber being in continuous communication with the cylinder chamber via at least one longitudinal passage contained in the externally threaded reduced portion of the metal shell which is adapted for mounting in a corresponding opening contained in the engine head.

In accordance with a more specific object of the invention, the storage chamber is annular and is concentrically arranged relative to the longitudinal axis of the shell. The chamber is preferably formed as an annular groove defined in the end wall of the shell body portion adjacent the shell reduced portion, which groove is closed by a layer of metal (deposited, for example, by welding).

BRIEF DESCRIPTION OF THE DRAWING

Other objects and advantages of the invention will become apparent from a study of the following specification when viewed in the light of the accompanying drawing, the single FIGURE of which is a detailed view of a anti-pollution spark plug of the present invention.

DETAILED DESCRIPTION

Referring now to the drawing, the spark plug 2 includes a conventional central electrode 4 which extends in concentrically spaced relation through the tubular metal shell 6 and is supported therein by a tubular ceramic insulator 8 arranged concentrically between the central electrode and the shell. Compacted powder seals 10 formed under high pressure provide a permanent assembly and eliminate leakage.

The metal shell 6 includes a body portion **6*a*, and an enlarged hexagonal head portion 6*b* adapted for engagement by a socket wrench during assembly of the spark plug to the head 12 of the internal combustion engine. At its other end, the spark plug includes an externally threaded reduced portion 6*c* that is adapted for threaded mounting in a corresponding opening 12*a* contained in the engine head. A conventional spark plug gasket 14 is compressed between the spark plug and the corresponding counterbored surface in the head. An inside gasket 16 affords a cushion seal and good thermal contact between the insulator and the shell. In many spark plug embodiments, this inside gasket may be eliminated. Ground electrode 17 extends from the metal shell reduced portion 6*c* adjacent and spaced from the end 4*a* of the central electrode that projects slightly beyond the insulator 8.**

In accordance with the present invention, an annular storage chamber 18 is defined in the body portion **6*a* of the metal shell 6, said storage chamber being adapted for communication with the cylinder chamber of the engine via longitudinal passages 19 that extend through the reduced portion 6*c* and terminate in orifices contained in the end wall thereof. Preferably, the storage chamber is formed by providing an annular groove in the end wall of the body portion 6*a* adjacent the reduced portion 6*c*, said groove being closed by a metal layer 20** (deposited by welding, for example).

OPERATION

In operation, during the compression stroke of the internal combustion engine, unburnt hydrocarbons are admitted to the storage chamber 18 via the longitudinal passages 19 and are stored therein during combusion of the fuel in the cylinder. Upon ignition some of the products of combustion enter the storage chamber 16 and render the storaged hydrocarbons non-combustible by mixing with them. During the subsequent expansion stroke, the stored hydrocarbons are returned to the cylinder for mixing with the combustion gases. Owing to the relatively high temperature of the cylinder (i.e., at least 2200° Rankine), the hydrocarbons mix with the oxides of nitrogen having an excess concentration relative to an equilibrium value defined by the pressure, temperature and composition parameters of the products of combustion, thereby reducing the oxides of nitrogen to the equilibrium value. Consequently, the undesirable oxides of nitrogen pollutants are removed from the exhaust gases from the internal combustion engine.

What is claimed is:

1. A spark plug adapted to reduce the oxides of nitrogen contained in the combustion products of an internal combustion engine, said oxides of nitrogen having an excess concentration relative to an equilibrium value defined by the pressure, temperature and composition parameters of said products of combustion, comprising a. a tubular metal shell having a body portion, a noncircular enlarged portion at one end of said body portion, and an externally threaded portion of reduced diameter at the other end of said body portion, said reduced externally threaded opening contained in the head of an internal combustion engine;

b. a center electrode extending coaxially in spaced relation through said shell;

c. a tubular ceramic insulator arranged concentrically between said center electrode and said shell for supporting said electrode in said shell, said center electrode porjecting at one end beyond said insulator adjacent the reduced end of said shell; and d. a ground electrode connected with said shell and extending in spaced relation adjacent said projecting center electrode end, thereby to establish a spark in a cylinder of the engine when said shell is threadably connected in the head opening;

e. said shell body portion containing a closed continuous annular storage chamber arranged concentrically about the longitudinal axis of said shell, and said reduced portion containing at least one longitudinal passage communicating at one end with said storage chamber, the other end of said passage terminating in an orifice contained in the free end surface of said reduced portion, whereby unburned hydrocarbons stored in said storage chamber during the compression stroke of the engine are returned to the cylinder during the expansion stroke following combustion, thereby to reduce the oxides of nitrogen to the equilibrium value.

2. Apparatus as defined in claim 1, wherein said storage chamber is defined by a continuous annular groove formed in the end wall of the body portion adjacent said reduced portion, and an annular layer of metal closing the mouth of the groove to define said storage chamber.

* * * * *